US006913559B2

(12) United States Patent
Smith

(10) Patent No.: US 6,913,559 B2
(45) Date of Patent: Jul. 5, 2005

(54) APPARATUS FOR MONITORING AND DISPLAYING EXERTION DATA

(76) Inventor: Carl M. Smith, 1310 Bishop La., Alexandria, VA (US) 22302

( * ) Notice: Subject to any disclaimer, the term of this patent is extended or adjusted under 35 U.S.C. 154(b) by 497 days.

(21) Appl. No.: 10/101,429

(22) Filed: Mar. 18, 2002

(65) Prior Publication Data

US 2002/0155925 A1 Oct. 24, 2002

Related U.S. Application Data

(63) Continuation-in-part of application No. 09/314,026, filed on May 19, 1999, now Pat. No. 6,358,187.

(51) Int. Cl.[7] ..... A63B 21/00

(52) U.S. Cl. ..... 482/4; 482/1; 482/8; 482/111; 73/379.01

(58) Field of Search ..... 600/587, 595, 600/300; 601/23, 33, 40; 482/1–9, 900–902, 92, 111–113; 73/379.01–379.03

(56) References Cited

U.S. PATENT DOCUMENTS 6,033,370 A * 3/2000 Reinbold et al. ..... 600/595

* cited by examiner

*Primary Examiner*—Glenn E. Richman
(74) *Attorney, Agent, or Firm*—IP Strategies

(57) ABSTRACT

An apparatus for monitoring and displaying information related to pressure exerted at a point of interest during an isometric exercise includes a fabric base, adapted to receive a body part. A sensor is attached to the fabric base and disposed at the point of interest during the isometric exercise, and measures a pressure magnitude at the point of interest and provides a pressure signal corresponding to the pressure magnitude. A processing unit is attached to the fabric base and receives the pressure signal, processes the pressure signal to derive information that is meaningful to a user, and generates a display corresponding to the information derived from the pressure signal.

40 Claims, 14 Drawing Sheets

APPARATUS FOR MONITORING AND DISPLAYING EXERTION DATA

REFERENCE TO RELATED APPLICATION

This is a continuation-in-part of U.S. patent application Ser. No. 09/314,026, which was filed on May 19, 1999, now U.S. Pat. No. 6,358,187, the entire description of which is incorporated herein.

FIELD OF THE INVENTION

The present invention relates in general to resistance exercise systems. In particular, the present invention relates to a device that monitors the effort of a person performing a resistance exercise and provides feedback on that person's performance.

BACKGROUND OF THE INVENTION

Physical fitness is a growing concern among people around the world. As a result, activities involving all forms of exercise have become increasingly popular. While many people limit their activities to cardiovascular-type exercises, others have discovered the many benefits of resistance training. Resistance training belongs to the category of exercise systems in which the muscles are worked to partial or total failure against an opposing force, usually gravity or a spring force of some type. Through proper nutrition and rest, the muscles recover such that they are stronger than before the failure was induced. Resistance training in general has been shown to increase lean muscle mass, strengthen joints, improve posture, and raise metabolic levels. It is generally believed that maximum health benefits can be obtained by following an exercise program including a combination of cardiovascular and resistance training. Thus, resistance training should form at least a component of a person's exercise regimen.

Traditionally, people have gone to gyms having weight rooms in order to perform resistance training. These weight rooms are typically equipped with free weights and resistance training machines, such as Nautilus® equipment. Membership fees to these gyms can be expensive, however. Further, memberships are frequently oversold, resulting in long waits to use equipment. Many people will not tolerate the inconvenience of working out in a gym, while others are intimidated at the idea of working out in the company of strangers.

The inconvenience and expense of exercising in a gym has led to the proliferation of products designed to provide resistance training capability in the home. These products range from large machines, such as universal gym machines, to smaller devices that can be stored in a closet. A universal gym might provide the capability to effectively train every major muscle group, but it is a large device that requires substantial space dedicated for its use. On the other hand, the smaller devices (such as hand grips) generally do not provide an effective, complete workout, as they tend to concentrate on only a single muscle group. In any case, these devices usually must be used at home or in another fixed location; spontaneous use of these devices in public settings is often not practical.

Isometric exercises, however, can be performed virtually anywhere, anytime. Isometric exercises refer generally to resistance training of the muscles by tension, usually provided by working the muscles in opposition to each other or against a substantially immovable object. For example, resistance training of the biceps muscles can be provided by pressing the palms of the hands upward against the underside of a desktop. Likewise, resistance training of the shoulders and chest can be provided by pressing the palms of the hands together and increasing the opposing pressure.

Thus, isometric exercises can be performed at home, in the office, or even while riding public transportation. At home, a person can use opposing muscle groups to provide the necessary tension for a particular exercise. Alternatively, the person can use an object such as a doorway as a base against which to push in order to isometrically exert his muscles. In the office, a desk can be used inconspicuously as a base, or a person can exert opposing muscles against each other while reading or doing other work. Similarly, these exercises can be performed while in a taxi or airplane, or while riding a bus or subway. The flexibility and convenience provided by the very nature of isometric exercises makes it more likely that a person will stick to an exercise plan.

Isometric exercise also allows resistance training to be performed in environments in which other forms of resistance training are impossible. For example, it is entirely impractical to provide resistance training equipment to astronauts stationed in space. Payload restrictions imposed on such missions simply do not allow the stowing of heavy equipment that is not critical to the purpose of the mission. However, isometric exercises can be performed without the use of such equipment, and can be performed without leaving a particular workstation or while complying with other physical restrictions. Isometric exercise is therefore well suited for use by those involved in the space program.

Currently, isometric exercises provide an effective resistance training workout, but provide no indication of the level of work being performed or of the progress made by the person performing the exercises. That is, conventional isometric exercises provide no quantitative measure of the effort exerted by the exerciser. This makes it impossible for the exerciser to set performance goals or to track improvement. Many people require such quantitative data in order to remain motivated to continue with an exercise program.

SUMMARY OF THE INVENTION

It is therefore an objective of the present invention to provide a device that monitors certain performance characteristics of a person performing an isometric exercise.

It is a further objective of the present invention to provide a device that provides a quantitative indication of the performance level of an isometric exercise.

It is an additional objective of the present invention to provide a device that indicates to a user when a specific performance goal has been reached when performing an isometric exercise.

It is another objective of the present invention to provide a device that stores quantitative data corresponding to previous isometric exercise performance achievements.

The present invention is an apparatus for monitoring and displaying exertion data. The apparatus includes a fabric base, a sensor, a sensor cable, and a processing unit. The sensor measures a pressure change or an instantaneous pressure at the sensor and provides a pressure signal corresponding to a magnitude of the pressure change. The pressure signal is transmitted over the sensor cable to the processing unit, which receives the signal, processes the signal according to processing instructions, and generates visual information for display.

Preferably, the sensor includes a transducer against which incident pressure is applied and which generates a voltage level proportionate to a magnitude of the incident pressure, and a converter that receives the voltage level and converts the voltage level to the pressure signal. The processing unit preferably includes a microprocessor that receives the pressure signal from the sensor cable, processes the pressure signal, and generates pressure data and visual information for display. In addition, the microprocessor includes computer memory, which stores 1) instructions used to control the processing of the pressure signal, 2) pressure data generated by processing the pressure signal, and 3) visual information to be used by the processing unit for display. Furthermore, the processing unit includes a display device, which provides a visual representation of the pressure data according to the visual information stored in the computer memory. The processing unit preferably includes a clock generator for providing a periodic output signal. The pressure data can include data corresponding to the pressure magnitude at the sensor, an instantaneous pressure at the sensor, data corresponding to a duration of incident pressure at the sensor, data corresponding to a duration that incident pressure at the sensor is maintained above a threshold pressure, measured by the output signal of the clock generator, data corresponding to a number of repetitions that incident pressure at the sensor crosses a threshold pressure in a positive direction, measured by the output signal of the clock generator, or data corresponding to a peak pressure incident at the sensor. The viewable representation of the visual information can include metaphorical representations of any of the quantities represented by the pressure data.

According to a particular aspect of the invention, the sensor, the sensor cable, and the processing unit are attached to a fabric base, which is preferably formed in the shape of a fingerless glove that is adapted to receive a hand. Preferably, the sensor, the sensor cable, and the processing unit are disposed on regions of the fabric base such that the sensor is located proximate to the base of the palm of the hand, the processing unit is located on the back portion of the hand, and the sensor cable is routed from the sensor to the processing unit around the hand in a manner that does not restrict movement of the hand or fingers.

According to another particular aspect of the present invention, an apparatus for monitoring and displaying exertion data includes a sensor that measures a pressure change at the sensor and provides a pressure signal corresponding to a magnitude of the pressure change, a processing unit that receives the pressure signal, processes the pressure signal according to processing instructions, generates pressure data corresponding to the pressure signal, and displays a visual representation of the pressure data, and a sensor cable that provides an electrical connection between the sensor and the processing unit. The sensor provides the pressure signal to the processing unit via the sensor cable. The sensor can include a transducer against which incident pressure is applied and which generates a voltage level proportionate to a magnitude of the incident pressure, and a converter that receives the voltage level and converts the voltage level to the pressure signal. The processing unit can include a microprocessor that receives the pressure signal, processes the pressure signal, generates the pressure data, and generates display data, and memory, in which the processing instructions and display data are stored and which provides the processing instructions to the microprocessor to control processing of the pressure signal and display of the visual representation. The processing unit can include a display for providing the visual representation based on the pressure data. The pressure signal can be a digital representation of the pressure change. The apparatus can also include a fabric base formed in the shape of a glove that is adapted to receive a hand, wherein the sensor and the processing unit are attached to the fabric base. The fabric base can be made from material including at least one of nylon, leather, and spandex. The fabric base can include at least one fastener that allows a fit of the fabric base on the hand to be adjusted, and the fastener can include a strap with a hook-and-loop fabric closure. The sensor can be disposed on a region of the fabric base such that the sensor is located proximate to the palm of the glove. The sensor can be a flexible monolithic pressure sensor. The sensor can be encased in the fabric base with closed-cell foam. The closed-cell foam can be covered with at least one aluminized layer. The sensor cable can include multiple flat flexible wires. The sensor cable can be routed from the sensor to the processing unit around a base of a thumb section of the glove, a base of a little finger section of the glove, between bases of a thumb section and index finger section of the glove, or a location where a wrist section of the glove joins a base of a thumb section of the glove. The sensor cable can be attached to the processing unit with a snap-fit connector. The sensor cable can be at least partially disposed between fabric layers of the fabric base. The processing unit can be disposed on a region of the fabric base such that the processing unit is located proximate to the back portion of the hand when the glove is worn by a user. The processing unit can include an upper case, a lower case, and a circuit assembly on which the microprocessor and memory are disposed. The apparatus can also include a gasket, disposed between the upper case and the lower case. The upper case can be secured to the lower case with screws. The upper case can be made of a polycarbonate material. The apparatus can also include at least one keypad disposed in at least one respective annular space in the upper case. The keypad(s) can be disposed in communication with a dome switch. The dome switch is electrically connected to an input lead of the microprocessor. The keypad can be made of santoprene. The circuit assembly can include at least one electrical contact to provide electrical communication between the sensor cable and the microprocessor. The electrical contact can include at least one coil spring. The electrical contact can include at least one zebra strip connector. The upper case can include at least one aperture through which electrical contact is made between the sensor cable and the electrical contact. The apparatus can also include a display device, wherein the upper case includes a lens over the display device. The lens can be made of at least one of an acrylic material and a clear polycarbonate material. The upper case can include a battery enclosure. The battery enclosure can be adapted to accept a CR2032 lithium battery. The processing unit can also include a piezo beeper, disposed in electrical communication with the microprocessor. The processing unit can also include a clock generator for providing a periodic output signal, disposed in electrical communication with the microprocessor. The processing unit can also include a signal transmitter, disposed in electrical communication with the microprocessor. The signal transmitter can be a radio frequency transmitter or an infrared transmitter. The display device can provide the visual representation of the pressure data at least in the form of a bar graph, or in the form of alphanumeric characters. The display device can include a liquid crystal display, which can be a double-supertwist nematic crystal.

BRIEF DESCRIPTION OF THE DRAWING FIGURES

These and other objectives and advantages of the present invention will be apparent from the following detailed description, with reference to the drawings, in which.

DETAILED DESCRIPTION OF THE PRESENT INVENTION

Figure 7:
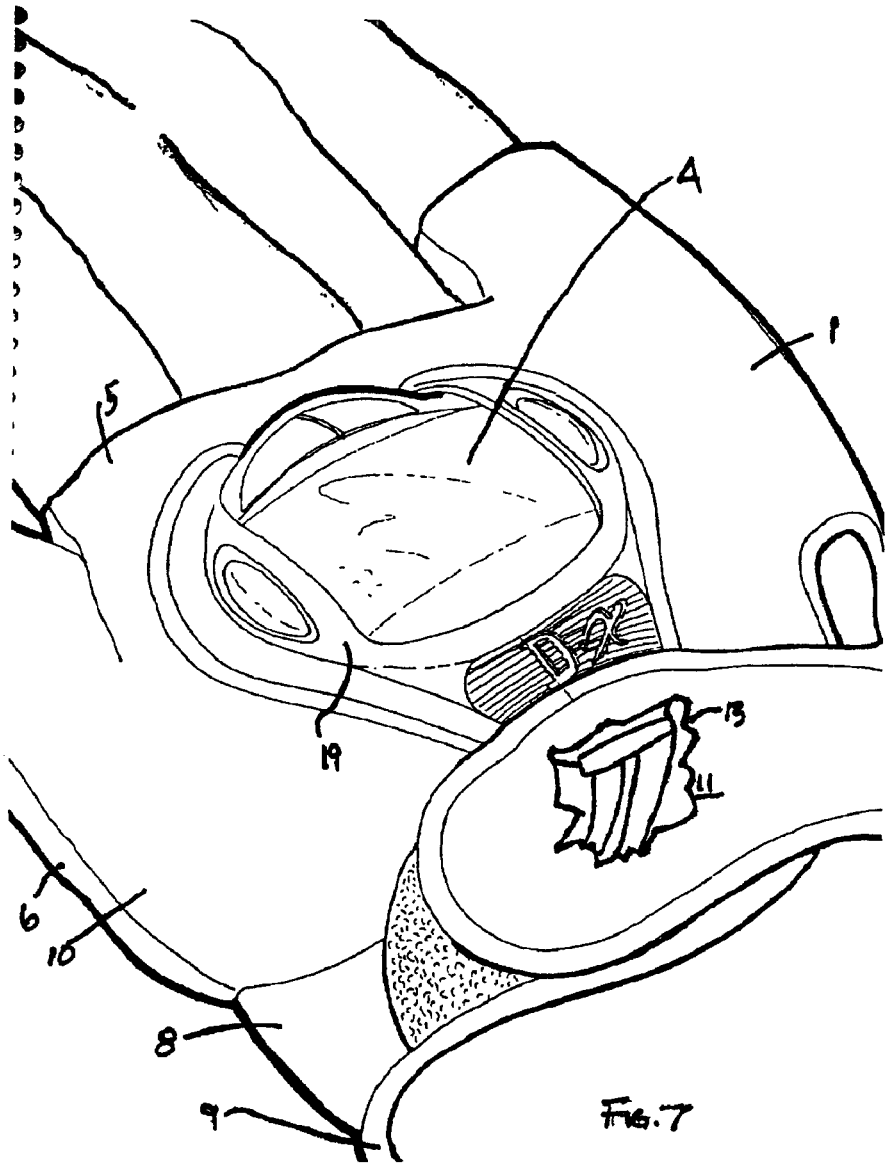
FIG. 7 shows an exemplary processing unit mounted on the fabric base and positioned on the back of the hand.
Figure 9:
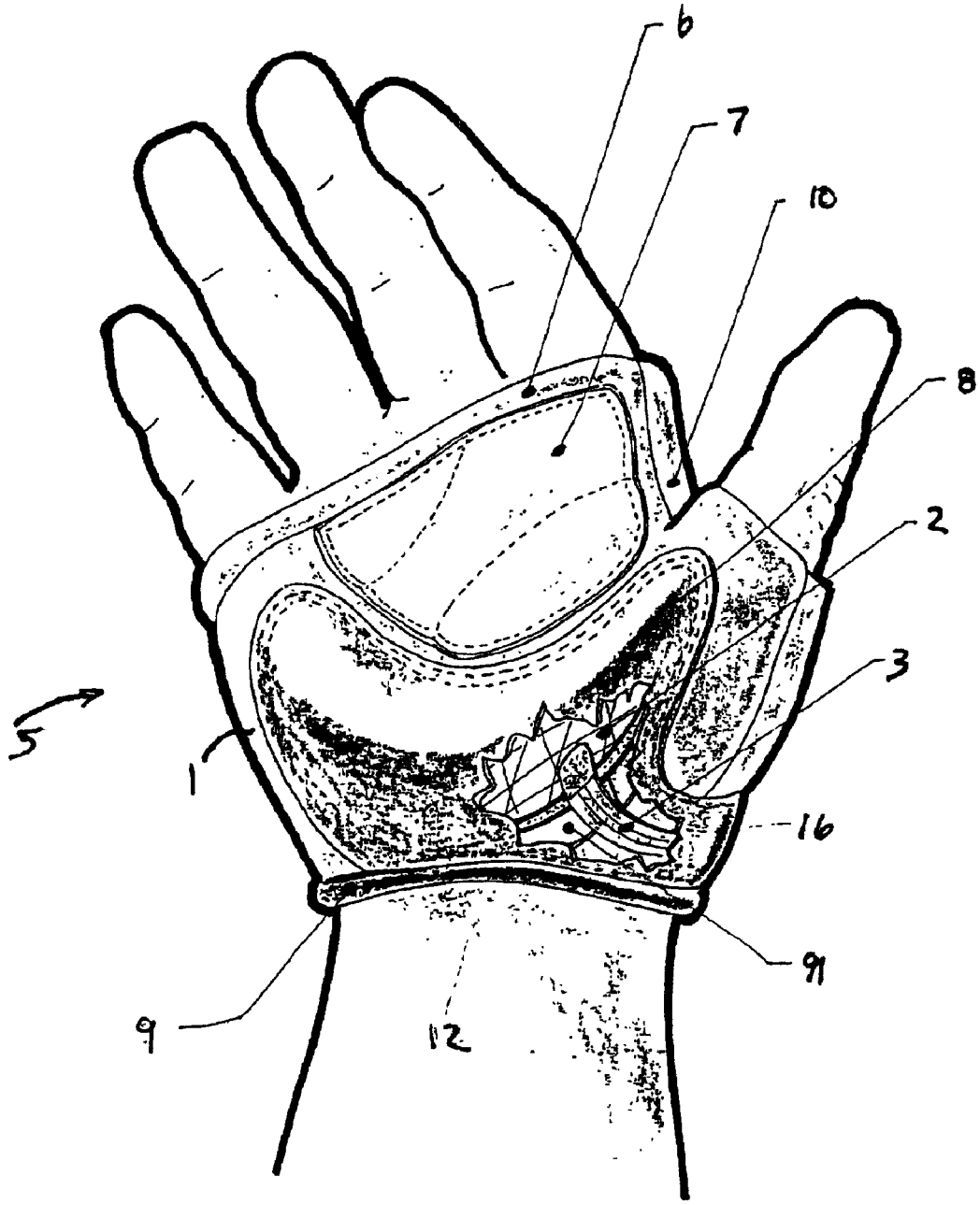
FIG. 9 shows the fabric base with a breakaway detail of the attachment of the sensor cable to the sensor.
Figure 14:
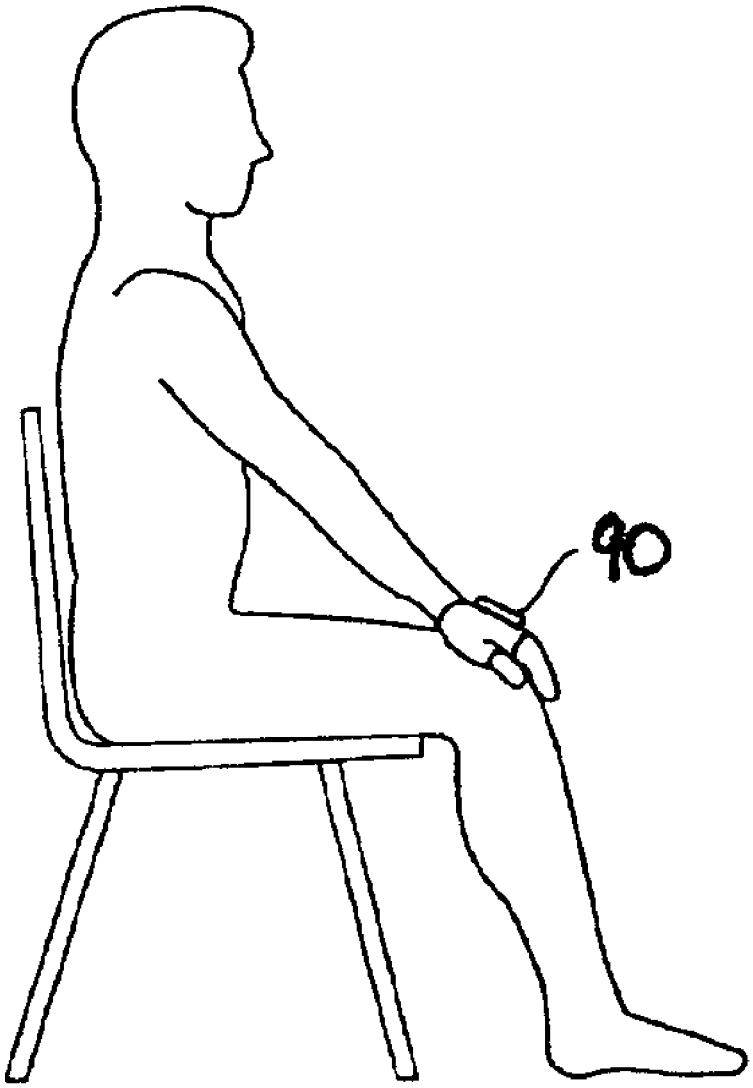
FIG. 14 is a diagram showing a user performing an exemplary isometric exercise using the device of the present invention.

With reference to FIGS. 7 and 9, the device of the present invention includes four primary components: a fabric base 1, a sensor 2, a flexible sensor cable 3, and a processing unit 4. The fabric base 1 serves as a structure that maintains the relative positions of the sensor 2, the sensor cable 3, and the processing unit 4 while a user is wearing the device, and secures the device to the user's hand. When the device is worn by a user, the position of the sensor 2 preferably is maintained proximate to the base of the palm of the hand, in order to be in the best position to measure pressure during isometric exercise. FIG. 14 shows a user having the device 90 of the present invention on his hand, performing an isometric exercise by applying pressure with the palm of his hand against his knee.

As shown in FIG. 9, the sensor 2 can be placed against the palm of the hand. According to an exemplary embodiment of the invention, a fabric base 1 in the form of a full or partial glove 5 is worn by the user, and the sensor 2 is placed inside the glove 5, against the palm of the user's hand or, alternatively, is embedded or inserted within the fabric of the glove 5. The sensor 2 thus remains held in position against the hand for convenience during the isometric exercise.

As shown in FIG. 7, the processing unit 4 is located on the glove 5 such that it is disposed on the back side of the user's hand when worn. The processing unit 4 and sensor 2 are connected by the sensor cable 3, which is preferably embedded in or sewn into the fabric of the glove 5.

The sensor 2 measures incident pressure as an indication of the exertion applied by the person performing the exercise. The sensor 2 can be any known type of pressure sensor, which typically have transducers for converting the sensed pressure to electrical signals corresponding to the level of pressure sensed. In an exemplary embodiment of the present invention, the sensor 2 is a digital pressure sensor that converts the sensed pressure to a digital signal, the magnitude of which corresponds to the magnitude of the sensed pressure.

Figure 2:
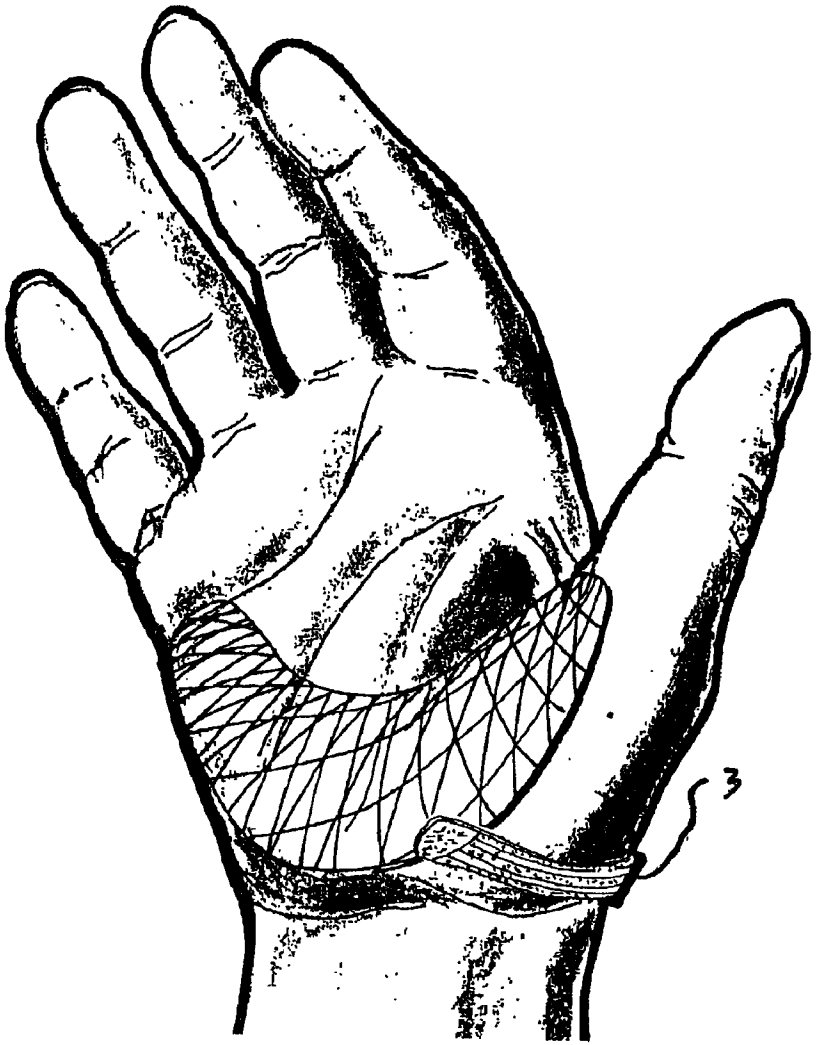
FIG. 2 shows the attachment of the sensor cable to the sensor at a location on the hand proximate to the wrist.
Figure 3:
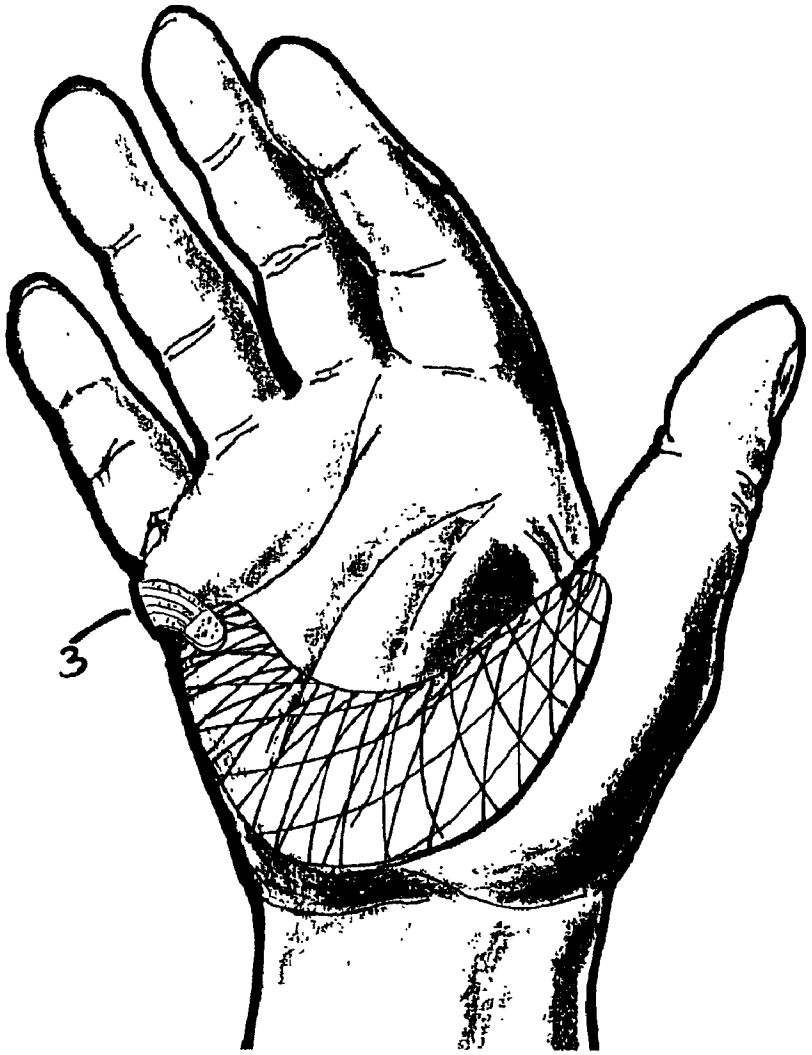
FIG. 3 shows the attachment of the sensor cable to the sensor at a location on the hand proximate to the little finger.
Figure 4:
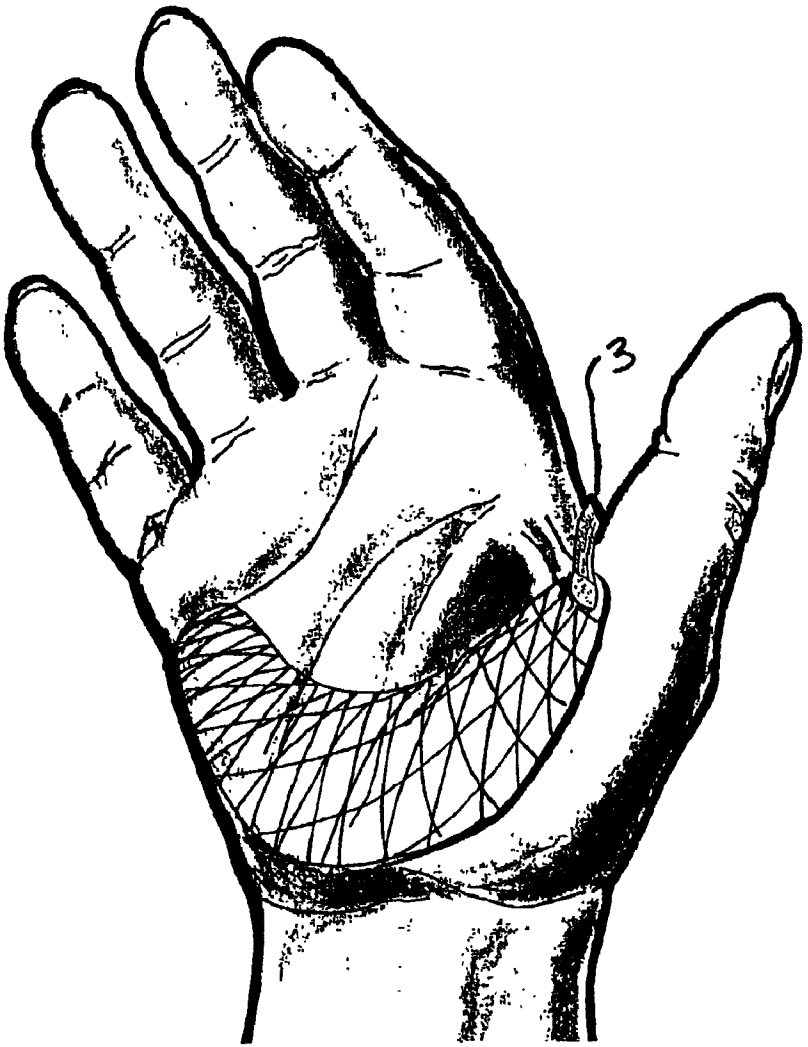
FIG. 4 shows the attachment of the sensor cable to the sensor at a location on the hand proximate to the interior portion of the thumb.

The sensor 2 provides the pressure signal to the processing unit 4 via the sensor cable 3. As shown in FIGS. 7 and 9, the sensor cable 3 has a sensor cable first end 12 in electrical communication with the sensor 2 and a sensor cable second end 13 in electrical communication with the processing unit 4. In certain embodiments, the sensor cable 3 is a data bus having a width of n lines, where n is a number greater than 1. The value of n depends on the degree of granularity required for the pressure measurement (if the sensor provides a digital pressure level signal in parallel), as well as the configuration of the input port of the processing unit 4 that will receive the sensor cable second end 13 and the processing capability of the processing unit 4. In one embodiment of the present invention, the sensor cable 3 is simply a flat, flexible, two-conductor wire. The sensor cable 3 can be embedded in or sewn into the fabric of the glove 5, between outer surfaces of the glove and an inner layer 91. FIG. 9 shows the sensor cable 3 disposed between two layers of fabric of the glove 5. As shown in FIGS. 2, 3, and 4, the sensor cable 3 can be routed from the sensor 2 to the processing unit 4 in any of a variety of ways. For example, the sensor cable 3 can be routed around the base of the thumb (FIG. 2), around the base of the last finger (FIG. 3), or between the thumb and first finger (FIG. 4).

Figure 1:
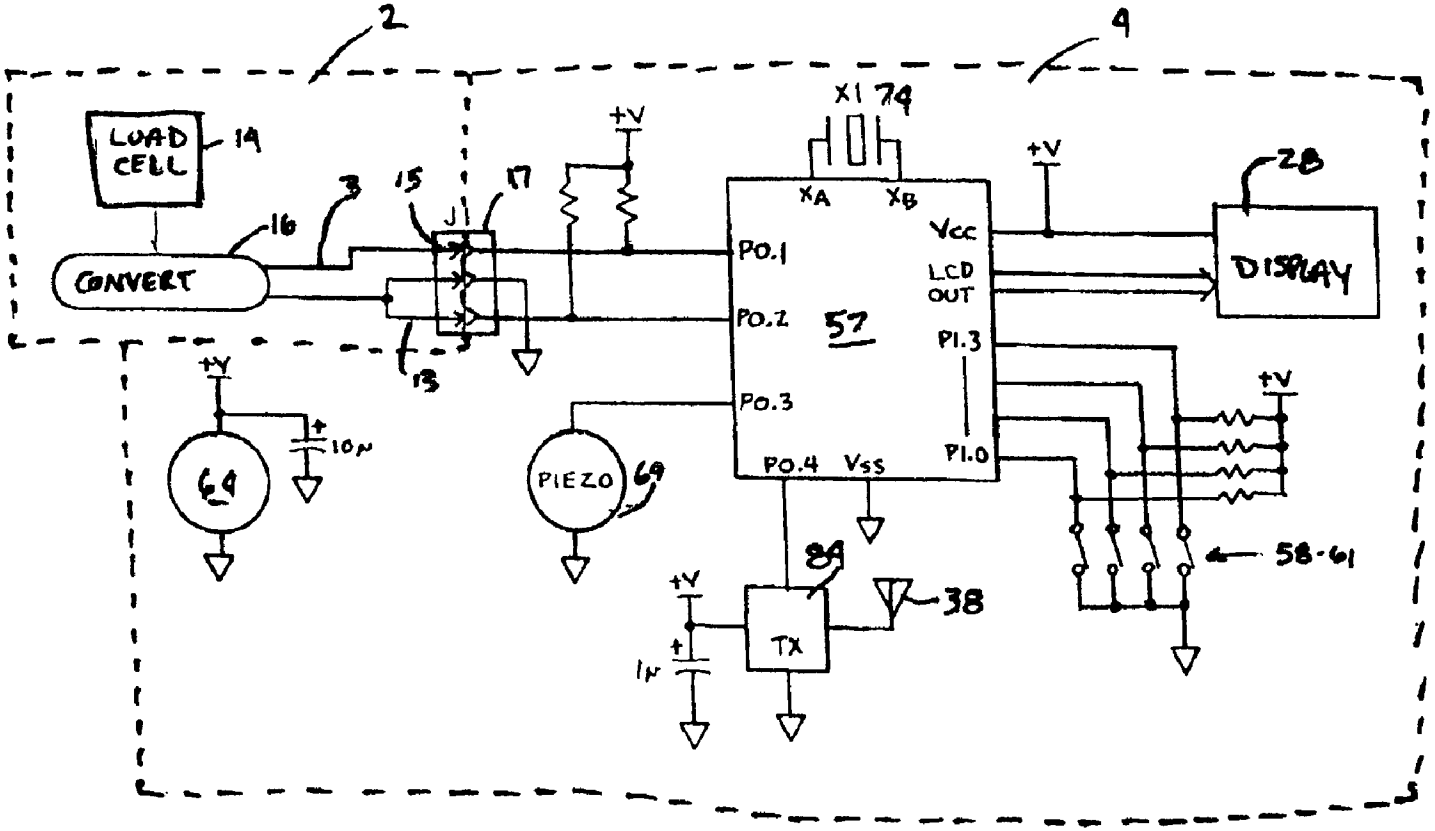
FIG. 1 shows a circuit schematic of the sensor and processing unit.

FIG. 1 shows a schematic diagram of an exemplary design for the sensor 2 and the processing unit 4. The sensor 2 includes a load cell 14 or other transducer, for converting incident pressure to a voltage level. For example, a typical load cell 14 includes a piezoelectric crystal which, under pressure, generates a voltage level that is proportionate to the magnitude of the incident pressure. The voltage across the crystal is then provided to a converter 16, which receives the voltage level and provides a corresponding pressure level signal that is usable by the processing unit 4. The exemplary design of the processing unit 4 shown in the figure is a digital design for circuitry including a microprocessor 57, a display 28, a radio transmitter 84, an oscillator or clock driver circuit 74, a piezo beeper 69, and dome switches 58–61. Power is provided to the circuitry by the coin-cell 64. As shown, the processing unit 4 receives a pressure level signal from the sensor 2 at the input port 17, where the signal can be buffered and is provided to the microprocessor 57. The microprocessor 57 processes the pressure level signal according to instructions stored in program memory, which in this embodiment is fabricated such that it is internal to the microprocessor 57. It is contemplated that a design utilizing a microprocessor having external program memory can be used instead.

The microprocessor 57 receives the pressure level signal, calculates the exertion information desired by the user based on the signal, stores necessary information in memory, and displays the appropriate information to the user on the display 28. In one embodiment, stored information is provided to display elements of the display 28 without further processing. In another embodiment, stored information is provided to display drivers, which convert the information to signals to be displayed by the display elements of the display 28. The display drivers can be formed integrally with the display. In one embodiment, the display elements are LCD elements, preferably manufactured as double-supertwist nematic crystal.

Through proper programming of the program memory with the instruction set for the microprocessor 57 and the display commands for the display 28, the processing unit 4 provides numerous functions and displays many types of information. The user has control over which information is determined, stored, and displayed through the use of the dome switches 58–61. One function is the processing and display of a measure of the pressure present at the sensor 2, which corresponds to the force exerted by the user in performing an exercise. Thus, the user has an immediate indication of his or her performance level for that exercise.

Another function monitors the duration of the exercise, that is, the length of time that the user sustains pressure at a particular point of contact. This duration is measured in terms of the cycle of a clock signal, which is provided to the microprocessor 57 by the clock driver circuit 74. The microprocessor 57 counts the number of clock cycles that pass while a positive pressure is measured at the sensor 2, or while pressure above a certain threshold is detected. If the pressure is pulsed or otherwise periodically varied during the exercise, the microprocessor 57 counts repetitions, such as when the measured pressure passes above and below predetermined thresholds, and displays repetition information to the user. Based on the pressure profile provided by the peak pressure measurement, number of repetitions, and duration of repetitions, the amount of work performed during the exercise can be calculated and displayed to the user.

Various exercise metrics can be provided to the user at strategic times during the exercise. In one embodiment, the user can interrupt the regular program of the microprocessor 57 in order to have particular information displayed. Generally, this is achieved when the user presses the left button 38, the right button 39, the left forward button 40, or the right forward button 41, which activate respective ones of the dome switches 58, 59, 60, 61. The dome switches 58, 59, 60, 61 are electrically connected as direct inputs to the microprocessor 57, to access the program stored in program memory, for example, at input port PI0–PI3 of the microprocessor 57.

The dome switches 58, 59, 60, 61 are provided to access instructions in program memory, which direct commands to the microprocessor 57 in order to provide the proper display information to the display 28. Depression of one or combinations of these switches can directly access a desired function. Alternatively, a single switch can be actuated to sequence through a series of memory addresses, thereby sequencing through different functions, to direct commands to the microprocessor 57 in order to provide the proper display information to the display 28 according to the selected function. As described, the dome switches can allow the user to access both dedicated and sequential functions.

In one exemplary embodiment, the four buttons 38, 39, 40, 41 are labeled or otherwise identified as "Reset/Clear", "Total", "Tone", and "Tx", respectively. Operation of the device using these buttons is described below.

Figure 13:
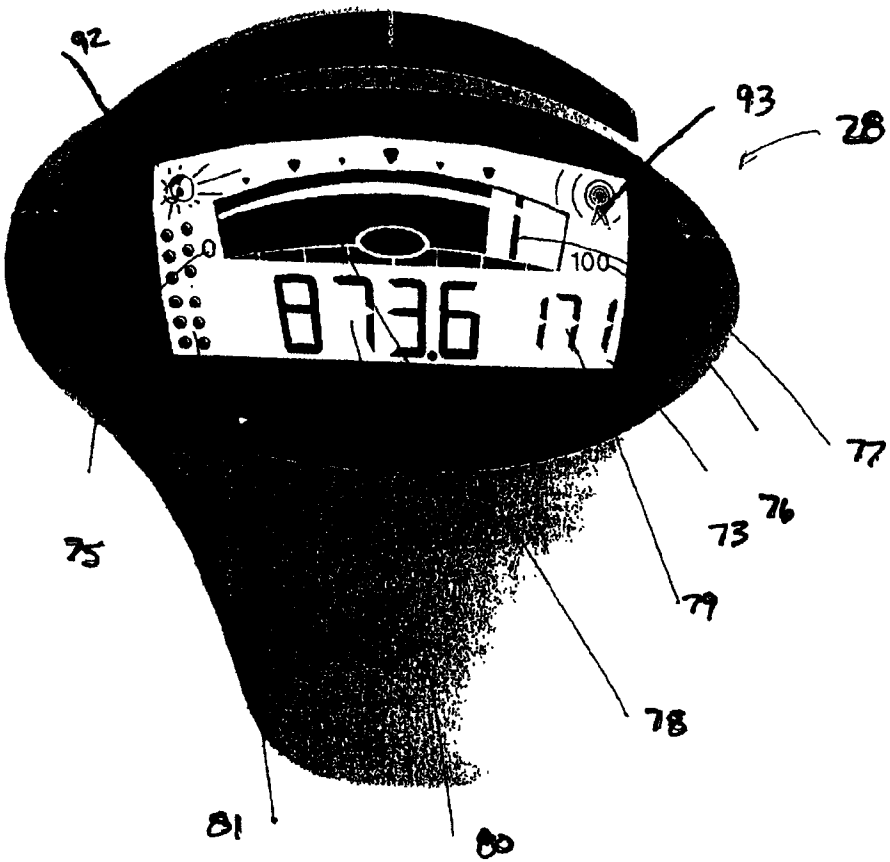
FIG. 13 shows the display device portion of an exemplary processing unit.

FIG. 13 shows an exemplary display 28 having distinct display areas, which show various types of information to the user. These display areas include a bar-graph display area 78 that is divided into a number of segments (twenty-five segments shown), and repetition indicators 81, here shown as a group of twelve circles. Preliminary to operation, the processing unit 4 is activated by pressing one of the primary function keys designated by either "Reset/Clear" or "Total", to send an activation instruction to the microprocessor 57. After pressing one of these keys, the information shown on the display 28 indicates that the processing unit 4 is ready for the user to begin exercising. This is demonstrated, for example, with the zero exertion value 75 displayed, the absence of a maximum exertion indicator 77, a clear bar-graph display area 78, and the timer indicator 79 displayed as "0.0". In addition, none of the repetition indicators 81 is highlighted.

Once the processing unit 4 is activated, it remains so during the time that the user is exercising. In an exemplary embodiment, if the processing unit 4 is activated and the sensor 2 does not measure any pressure change for a predetermined (fixed or selectable) period of time (for example, between 1 and 10 minutes), the processing unit 4 will turn off automatically. As part of the function of turning off, the processing unit 4 retains the accumulated exertion value for all repetitions (designated, for example, as T2). However, the display 28 is cleared of information and the stored data for the current exertion value (designated, for example, as T1), maximum exertion value, timer value, and repetition counter are set to zero.

Another exemplary function of the processing unit 4 incorporates an audible tone, which imparts certain information to the user while exercising. The "Tone" button activates the tone function, by causing tone instructions to be executed by the microprocessor 57. Once the button is pressed for the first time after activation of the device, the tone status is shown, that is, the text "Tone OFF" is shown in the data display area 80 for a short period of time, for example, between 2 and 3 seconds. Also, a tone icon 92 on the display can visually indicate that the tone function is off. If the "Tone" button is pressed a second time while the "Tone OFF" text remains displayed, then the tone function is activated. The tone icon 92 on the display now visually indicates that the tone function is on. With the tone function active, a tone emanates from the piezo beeper 69 (see FIG. 8) at regular intervals during the period that pressure is applied to the sensor 2. The tone sounds at regular intervals, which can be in some predetermined range, such as between 0.5 and 5 seconds. For example, the tone can sound once every second. The "Tone" button actuates a toggle function, that is, pressing the "Tone"button while the tone function is active deactivates the tone function. In this circumstance, the text "Tone OFF" is shown in the data display area 80 for a short period of time, such as between 2 and 3 seconds. With the tone function inactive, no tone emanates from the piezo beeper 69 during exercise.

Another function of the processing unit 4 allows a user to clear certain parameters stored in memory. A single press of the "Reset/Clear" button resets the processing unit 4, by causing the microprocessor 57 to execute an appropriate instruction. As a result, the information shown on the display 28 indicates that the processing unit 4 is ready for the user to begin exercising. This is demonstrated, for example, with the zero exertion value 75 displayed, the absence of a maximum exertion indicator 77, a clear bar-graph display area 78, and the timer indicator 79 displayed as "0.0". In addition, none of the repetition indicators 81 is highlighted. At the same time, the current exertion value, T1, is reset to zero, while the accumulated exertion value for all repetitions, T2, remains stored in memory. According to an exemplary embodiment, with a second successive press of the "Reset/Clear" function key, the text "CLEAR ALL?", or other confirmation prompt, is shown in the data display area 80. If the "Reset/Clear" function key is again pressed within a predetermined period of time, for example, between 2 and 3 seconds, then all values in memory are reset to zero, including the accumulated exertion value for all repetitions, T2.

Another function of the processing unit 4 allows a user to display the accumulated exertion value for all repetitions, T2, since the memory storage for T2 was last cleared. With a single press of the "Total" button, an appropriate instruction is executed by the microprocessor 57, and the accumulated exertion value for all repetitions, T2, is shown, for example, in the data display area 80. With a subsequent press of the "Total" button, or after a predetermined time delay, any information shown on the display 28 prior to the initial press of the "Total" button is displayed once again.

Once the processing unit 4 is activated and a user begins to exercise, a contiguous group of LCD segments within the bar-graph display area 78 is shown in a manner that provides a graphical representation of the instantaneous pressure exerted at the sensor 2. A numerical value representing the instantaneous pressure exerted at the sensor 2 can be shown in the data display area 80 as well. In addition, the timer indicator 79 displays the number of seconds and tenths of seconds that elapse while pressure is exerted at the sensor 2. When pressure is released, the contiguous group of LCD segments displayed within the bar-graph display area 78 is cleared with the exception of a single LCD segment, the maximum exertion indicator 77, which represents the highest pressure exerted during an exercise session. Any of the LCD segments of the bar-graph display area 78 can serve as the maximum exertion indicator 77 at any point in time during an exercise session so long as the LCD section displayed is representative of the highest pressure achieved to that point in time. The total exertion for the most recent exercise repetition is shown in the data display area 80 as "T1=XXX" where 'XXX' represents the pressure level recorded during the most recent repetition multiplied by the number of seconds the pressure level was maintained. The value of the timer at the moment pressure was released remains displayed as shown by the timer indicator 79. In addition, one of the repetition indicators 81 is highlighted.

As the user begins a second repetition, a contiguous group of LCD sections within the bar-graph display area 78 is again shown in manner that provides a graphical representation of the instantaneous pressure exerted at the sensor 2. A numerical value representing the instantaneous pressure exerted at the sensor 2 can be shown in the data display area 80. In addition, the value of the timer is reset to zero, and the timer indicator 79 again displays the number of seconds and tenths of seconds that elapse while pressure is exerted at the sensor 2.

When pressure is released, the contiguous group of LCD segments displayed within the bar-graph display area 78 is again cleared with the exception of a single LCD segment, the maximum exertion indicator 77, which represents the highest pressure exerted during the exercise session. A new LCD segment representing the maximum exertion indicator 77 is displayed only if the pressure exerted for the most recent repetition is greater than all other pressure measurements for a given exercise session. Otherwise, the LCD segment previously representing the maximum exertion indicator 77 remains displayed. The total exertion for the most recent repetition is again shown in the data display s area 80 as "T1=XXX" where 'XXX' represents the force level during the prior repetition multiplied by the number of seconds the force level was maintained. The program instructions for the microprocessor 57 determine how the instantaneous pressure level is sampled to determine the value of T1 for a variable pressure level at the sensor 2.

The value of the timer at the moment pressure is released remains displayed as shown by the timer indicator 79. In addition, an additional repetition indicator 81 is highlighted. Furthermore, if the tone function is activated, a tone sounds at regular intervals. Alternatively, the device can be programmed such that the tone sounds only if the pressure applied at the sensor 2 is at least a particular percentage of the maximum pressure applied in the preceding repetition, for example, between 80% and 90%. If the pressure fails to reach this specified percentage, the user will be deemed to be out of the "target range"and no tone will sound. If the tone function is activated and the user exceeds the previous highest pressure exerted during an exercise session, then a distinctive tone will emanate from the piezo beeper 69, indicating that a new value for the highest pressure exerted during a given exercise session has been achieved. For example, this distinctive tone can consist of two tones in succession with the second tone having a higher pitch than the first. Finally, as the user continues repetitions during an exercise session, the value of the accumulated exertion value for all repetitions, T2, is maintained in memory, to be displayed when requested by the user.

Figure 5:
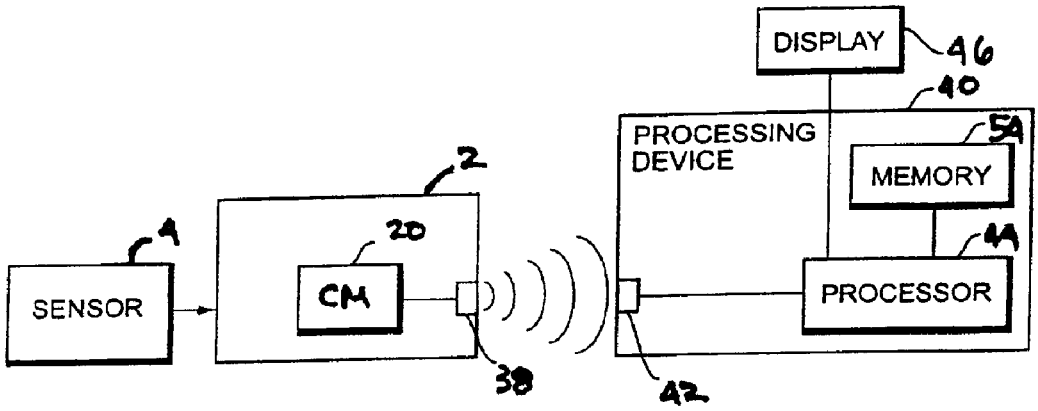
FIG. 5 is a block diagram showing an exemplary embodiment of the present invention, including a wireless remote processing device and alternative remote display.
Figure 6:
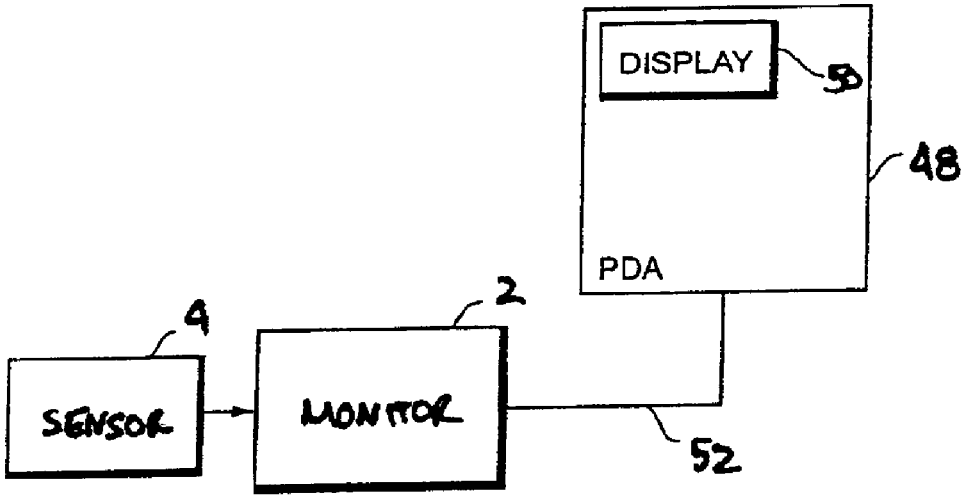
FIG. 6 is a block diagram showing an exemplary embodiment of the present invention, including a wired remote processing device and alternative remote display.

As previously described, another function of the processing unit 4 allows a user to transmit the exertion information to a remote processor 40, for presentation of data on an alternative display 50, or for storage of the information for later display, as shown in FIGS. 5 and 6. Pressing the "Tx" button causes the microprocessor 57 to execute an instruction to control the RF transmitter 84 to transmit currently-displayed exertion information. The microprocessor 57 provides this information to the RF transmitter 84 in a format that is suitable for modulation by the RF transmitter 84. A transmit icon 93 on the display can visually indicate that data is being transmitted.

The processing unit 4 of the device can be equipped with a driver and antenna 38 for providing a wireless signal to a remote processing device 40, as shown in FIG. 5. This wireless signal can have an infrared, radio frequency, or other type of carrier, as well known to those of skill in the art. For example, the driver can be a radio transmitter 84 that operates at a frequency of 434 MHz. In this exemplary embodiment, the circuitry on the printed circuit board 56 includes such a radio transmitter 84 (see FIG. 1).

The radio transmitter 84 can include an omnidirectional transmission element, connected to a corresponding antenna or array. The remote processing device 40 contemplated for use with the device is equipped with an input port 42 and processing capability 44 to receive the wireless signal and process the exertion information included in the signal. The microprocessor 57 of the processing unit 4 attaches the information to the carrier by, for example, well-known modulation methods. The resulting signal is transmitted to the remote processing device 40, where it is received at the input port 42 and passed to the processor 44 to strip away the carrier by, for example, demodulation. The wireless signal can be encoded or include a header, provided by the microprocessor 57, so that transmission of the wireless signal does not interfere with reception by other devices that might be within the transmission zone of the processing unit 4.

The information is then processed for presentation to the user on a display 46, which can be disposed at a location that is remote from the remote processing device 40, or can be constructed as a unit with the remote processing device 40.

The information can be presented to the user in real time, or it can be stored in memory 54 at the remote processing device 40, for later retrieval and presentation to the user.

The remote processing device 40 can be designed specifically for use with the device of the invention, or the remote processing device 40 can be a computer, such as an Intel®-based PC or a Macintosh® computer. Any type of device having processing capability is contemplated for use with or as part of the invention, including televisions, VCRs, video game receivers, video arcade machines, and personal data assistants (PDAs).

The information can be derived from the wireless signal, processed, and provided to the display 46 for presentation conventionally. Alternatively, the processor 44 can be can be specially designed or can run software that enables the display 46 to present a more motivational or interactive representation of the exertion information to the user. This representation can be as simple as a bar graph that shows exercise progress corresponding to the force exerted at the sensor 2. The representation can be more metaphorical, showing, for example, a hill representing the user's exercise goal and a person rolling a large stone up the hill to represent the user's progress toward that goal. Such a representation would be particularly appropriate when the processing device is a computer, television, or video game device, but can be used with any combination of processing device and display.

FIG. 6 shows a particular embodiment of the invention, in which the remote processing device 40 is a PDA 48, such as a Palm Pilot® or other Palm-type device, or a Newton®. The PDA 48 can be connected to the processing unit 4 by wireless link as described above, or via a direct physical link 52, such as via a shielded electrical cable, connected to an output port# of the processing unit 4. The shielded cable can be used in situations in which electromagnetic interference is a consideration, such as aboard an aircraft. The exertion information is provided by the monitor to the PDA 48, where it is processed for presentation to the user on a display 50, as described above. The information can be presented to the user in straight-forward or metaphorical format, as previously described.

Figure 10:
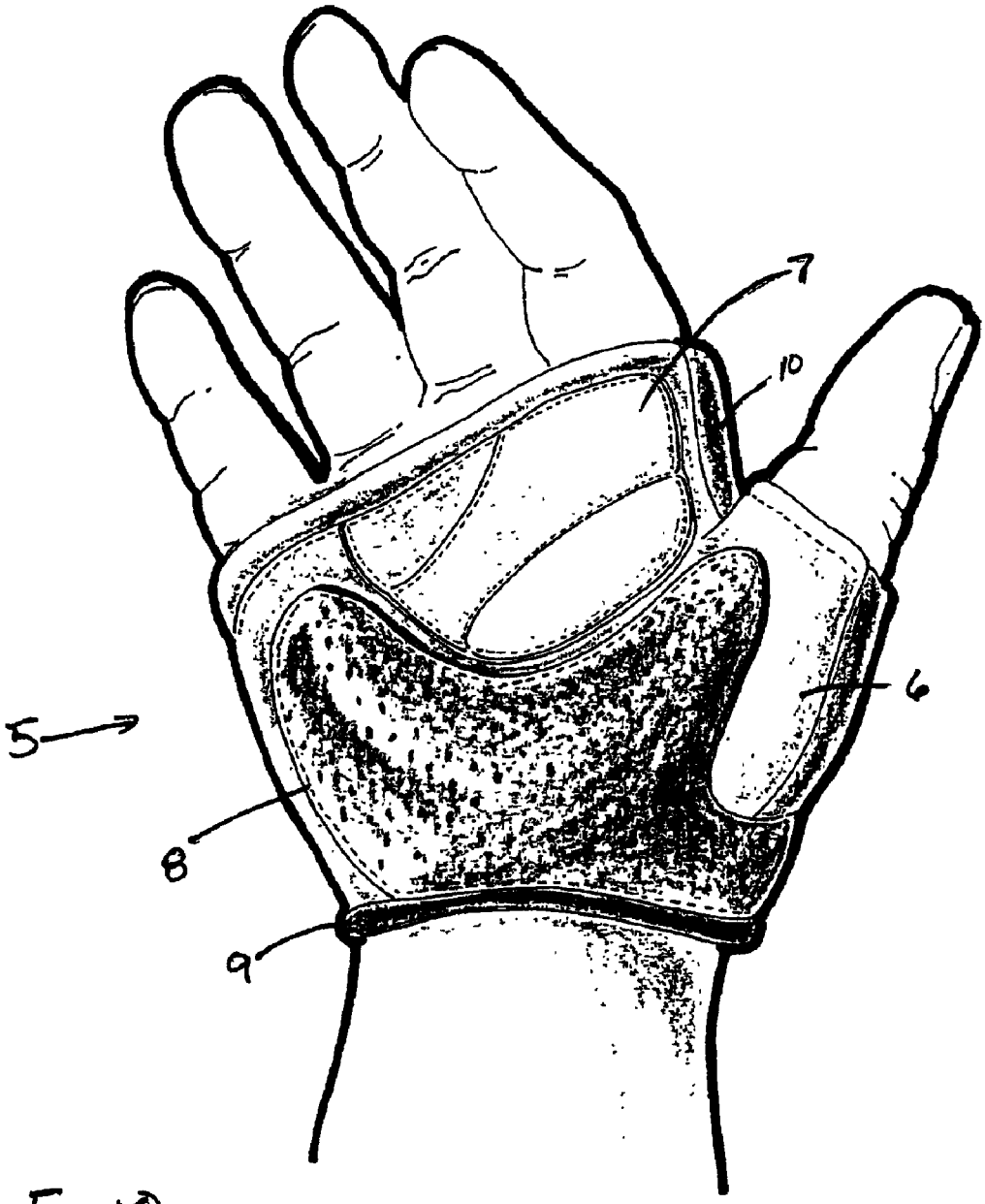
FIG. 10 shows an exemplary fabric base without finger loops.
Figure 11:
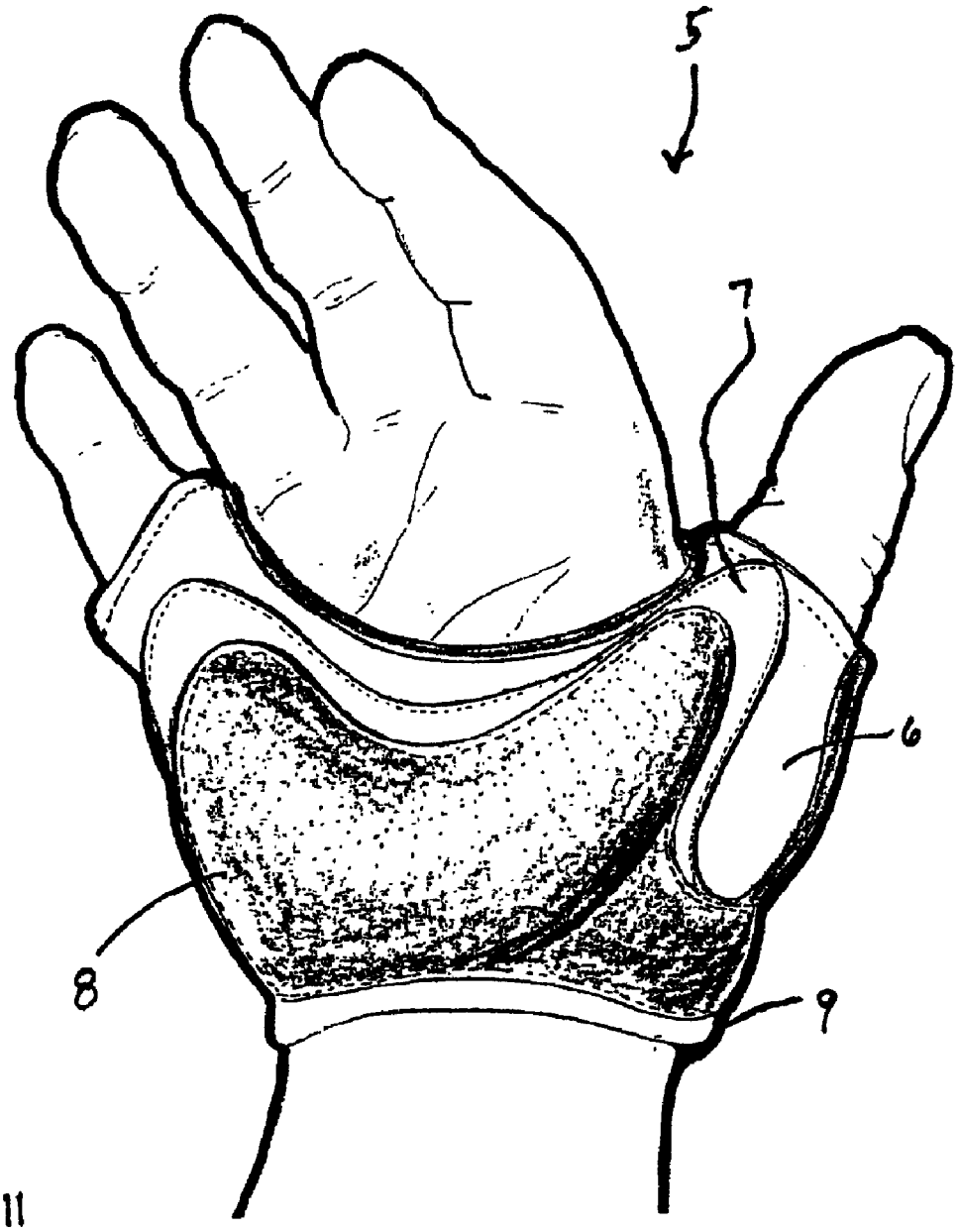
FIG. 11 shows an exemplary fabric base without covering the upper portion of the palm and having a finger loop for the little finger.
Figure 12:
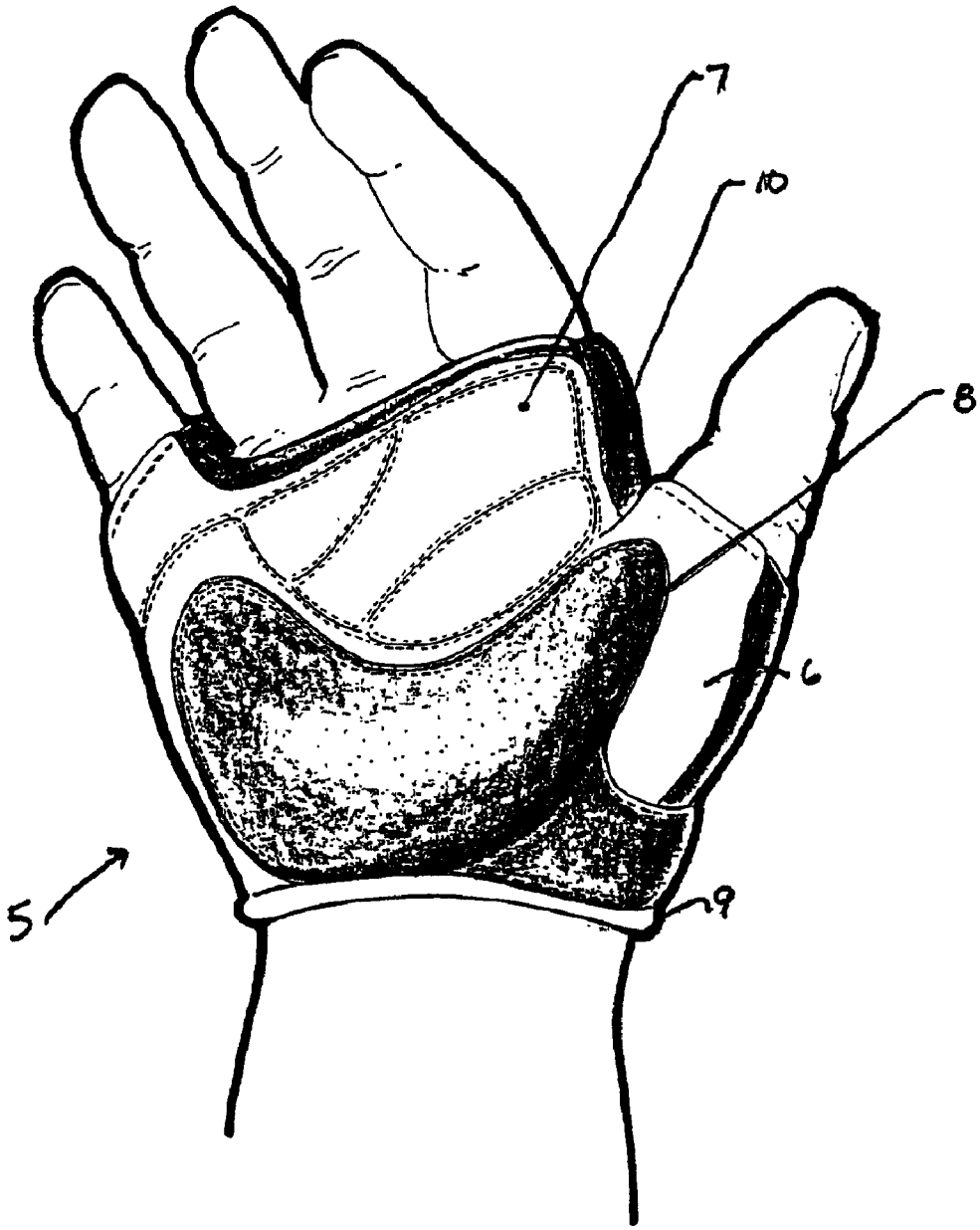
FIG. 12 shows an exemplary fabric base covering the upper portion of the palm and having a finger loop for the little finger.

As shown in FIGS. 10, 11, and 12, an exemplary configuration for the device is in the form of a glove 5 worn by the user. The glove 5 can be made of any suitable material, such as any combination of Spandex®, nylon, and leather, and can include a flexible elastic border or webbing to ensure a snug fit on a user's hand. In addition, the fit of the glove 5 can be adjusted through the use of straps or other fasteners, which can be held in place by Velcro® hook and loop material, snaps, or other closures.

The glove 5 can be fabricated in any of a number of configurations, as long as the sensor 2 is secured in a position that is advantageous for performing isometric exercise, and the processing unit is disposed such that the display is easily readable by the wearer. For example, FIG. 10 shows an embodiment of the glove 5 that covers the palm completely, and leaves the four fingers free to move without relative restriction. FIG. 12 shows an embodiment having a similar configuration, except that the last finger is fixed in position with respect to the glove 5. FIG. 11 depicts yet another possible configuration, in which the last finger is again fixed by the glove 5, but the top portion of the palm is exposed.

The glove 5 can be assembled from a number of sections of fabric that are arranged and attached together so as to conform to the shape of the hand. For example, a base section 6, an upper palm section 7, a sensor cover 8, and piping 9 can be made of leather, while the back section 10 (see FIG. 7) can be made of Spandex® or similar type of elastic fabric. In addition, as shown in FIG. 7, a strap 11, attached to the base section 6, made of leather or other material, fastens to a surface on the back of the base section 6. The upper surface of the base section 6 and the facing surface of the strap 11 can snap together, or alternatively can include mating hook and loop fastener fabric, such as Velcro®, to provide an adjustable, snug fit.

As shown in FIG. 9, the sensor 2 can be disposed between two layers of fabric of the glove 5. The sensor 2 thus remains held in position proximate to the user's hand to record the most accurate pressure measurements during isometric exercise. The sensor 2 measures the pressure that results from exertion against a substantially fixed object, applied by a person performing an isometric exercise. The sensor 2 can be any known type of pressure sensor, which typically has a load cell or other transducer for converting the sensed pressure to electrical signals corresponding to the level of pressure sensed. For example, a typical load cell includes a piezoelectric crystal, which, under pressure, generates a voltage that is proportionate to the magnitude of the incident pressure. The voltage across the crystal is then provided to a converter, which provides a pressure signal that can be used by a microprocessor. In an exemplary embodiment, the sensor 2 is a flexible monolithic palm pressure sensor. The sensor 2 can be a digital pressure sensor that converts the sensed pressure to a digital signal, the magnitude of which corresponds to the magnitude of the sensed pressure. In an exemplary embodiment, the sensor 2 is encased in closed-cell foam with aluminized outer layers.

As shown in schematic form in FIG. 1, the sensor cable second end 13 terminates at a sensor cable connector 15. The sensor cable connector 15 includes electrical connections and a housing, which can be made of molded plastic or other material. The housing fixes the positions of the electrical connections, and provides a mating connection, such as a snap-fit, with the input port 17 of the processing unit 4. The communication between the sensor cable second end 13 and the sensor cable connector 15 is such that the conductor wires 16 of the sensor cable 3 terminate in the electrical connections and are secured by the housing of the sensor cable connector 15. The conductor wires 16 at the sensor cable connector 15 terminate with hardware suitable for making electrical contact with the processing unit contacts 18 (see FIG. 8) at the input port 17. The sensor cable first end 12 terminates similarly, for mechanical and electrical connection with the sensor 2.

Figure 8:
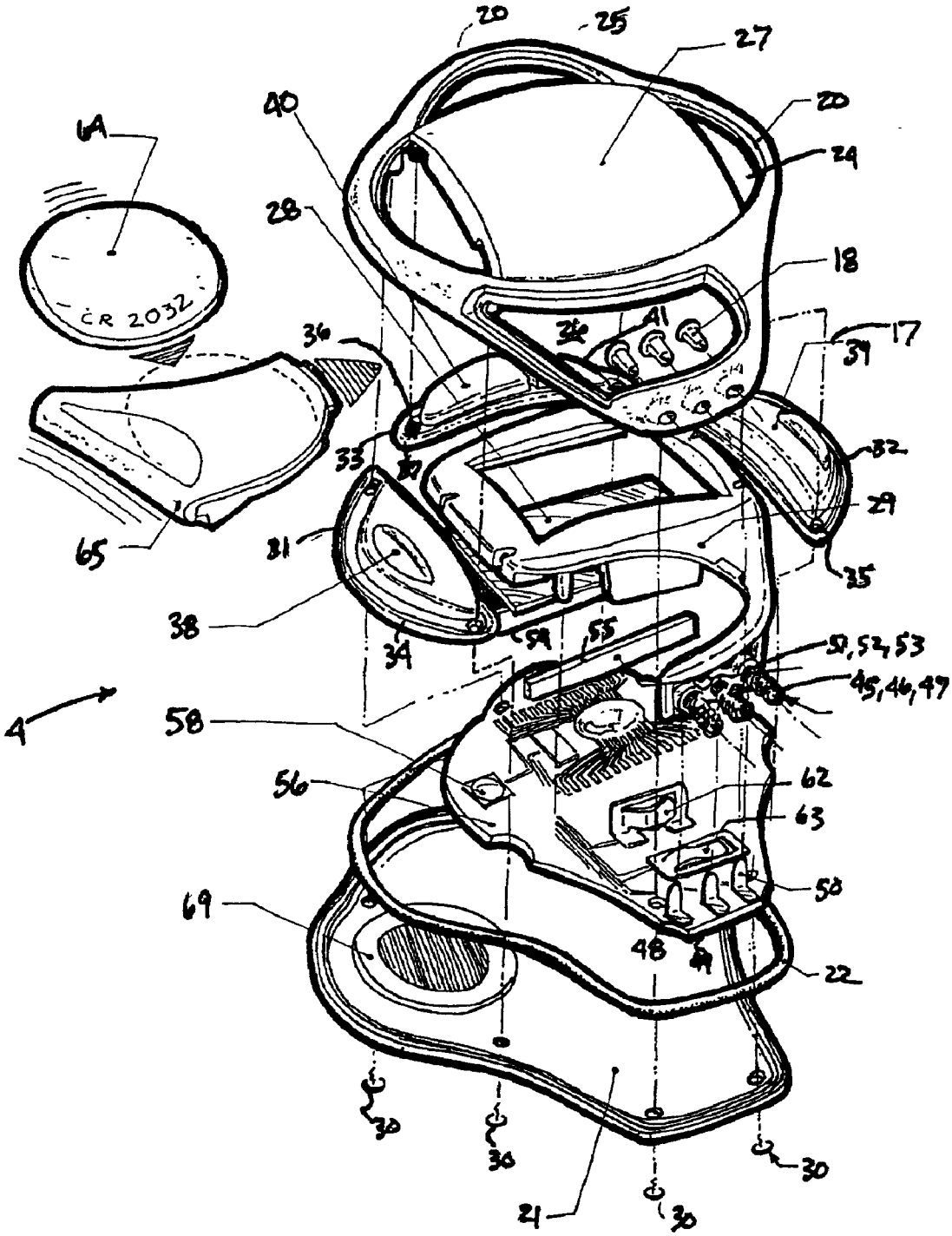
FIG. 8 shows an exploded view of an exemplary processing unit.

In an exemplary embodiment, as shown in FIGS. 7 and 8, the processing unit 4 is contained within a housing 19 that includes an upper case 20, a lower case 21, and a gasket 22. The processing unit 4 is located on the glove 5 such that it is disposed on the back of the user's hand as shown in FIG. 7. The upper case 20 incorporates four distinct apertures identified as the left keypad opening 23, the right keypad opening 24, the forward keypad opening 25, and the battery door opening 26. In addition, the upper case 20 includes three contact apertures 42, 43, 44 in which three processing unit contacts 18 are disposed. In one exemplary embodiment, the upper case 20 is manufactured from a polycarbonate material or other suitable material and incorporates a lens 27, which allows a user to more clearly view information shown on the display 28. In another exemplary embodiment, the upper case 20 is manufactured from clear or tinted polycarbonate material without incorporating the lens 27. In this embodiment, the upper case 20 has an additional opening configured with flanges or other attachment mechanisms for securing and incorporating the lens 27 as a separate part. As a separate part, the lens 27 can be secured to the flanges of the upper case 20, for example, by using common solvent welding techniques, or can be secured by a simple snap fit. In addition, as a separate part, the lens 27 can be manufactured from clear polycarbonate or acrylic. In an exemplary embodiment, the lower case 21 is fabricated from stainless steel.

The interior face of the upper case 20 is disposed in communication with portions of the upper face of an alignment frame 29. In an exemplary embodiment, the alignment frame 29 is made from polycarbonate or a similar material. The upper case 20 and the alignment frame 29 can be friction fit together. The upper case 20 is secured to the lower case 21. In an exemplary embodiment, this is accomplished by using six self-tapping screws 30, such that the gasket 22 is secured in a position disposed between and in communication with the perimeter of the lower face of the upper case 20 and the upper face of the lower case 21. In an exemplary embodiment, the gasket 22 is made of an elastomeric material.

The perimeter of the upper face of a left keypad frame 31 is disposed in communication with a left keypad frame gasket 34. The left keypad frame gasket 34 is disposed in communication with portions of the left interior face of the upper case 20. Two of the self-tapping screws 30, the shafts of which pass through two respective apertures of the left keypad frame 31, secure the left keypad frame gasket 34 and a left button 38 in a position disposed between the upper case 20 and the left keypad frame 31. In an exemplary embodiment, the left button 38 is manufactured from molded santoprene or equivalent material that is suitable to be elastically depressed to an extent that a left dome switch 58 can be actuated below the left button 38. In an alternative embodiment, the left keypad frame 31, left keypad frame gasket 34, and left button 38 can be formed as an integral unit.

Likewise, the perimeter of the upper face of a right keypad frame 32 is disposed in communication with a right keypad frame gasket 35. The right keypad frame gasket 35 is disposed in communication with portions of the right interior face of the upper case 20. Two of the self-tapping screws 30, the shafts of which pass through two respective apertures of the right keypad frame 32, secure the right keypad frame gasket 35 and a right button 39 in a position disposed between the upper case 20 and the right keypad frame 32. In an exemplary embodiment, the right button 39 is manufactured from molded santoprene or equivalent material that is suitable to be elastically depressed to an extent that a right dome switch 59 can be actuated below the right button 39. In an alternative embodiment, the right keypad frame 32, right keypad frame gasket 35, and right button 39 can be formed as an integral unit.

The perimeter of the upper face of a forward keypad frame 33 is disposed in communication with a forward keypad frame gasket 36. The forward keypad frame gasket 36 is disposed in communication with portions of the forward interior face of the upper case 20. Two self-tapping screws 37, the shafts of which pass through two respective apertures of the forward keypad frame 33, secure the forward keypad frame gasket 36, as well as left and right forward buttons 40, 41, in a position disposed between the upper case 20 and the forward keypad frame 33. In an exemplary embodiment, the left forward button 40 and the right forward button 41 are manufactured from molded santoprene or equivalent material that is suitable to be elastically depressed to an extent that a left forward dome switch 60 and a right forward dome switch 61 can be actuated below the left forward button 40 and the right forward button 41, respectively. In an alternative embodiment, the forward keypad frame 33, forward keypad frame gasket 36, left forward button 40, and right forward button 41 can be formed as an integral unit.

In an exemplary embodiment, the alignment frame 29 has a substantially rectangular-shaped opening, orientated such that a user can view the display 28, which is disposed below the alignment frame 29, through the lens 27. The contact apertures 42, 43, 44 are located on the rearward end of the upper case 20, and each accommodates a respective one of the processing unit contacts 18. The alignment frame 29 has multiple, preferably three, channels 51, 52, 53, located on the rearward portion of the alignment frame 29. One of a like number of coil springs 45, 46, 47 is disposed within each of the channels 51, 52, 53. Each coil spring is fitted to the corresponding channel in a manner that limits lateral motion but allows relatively free reciprocating movement along the centerline of the corresponding channel. A first end of each of the coil springs 45, 46, 47 is disposed in communication with a corresponding one of the processing unit contacts 18. A second end of each of the coil springs 45, 46, 47 is disposed in communication with a respective one of three circuit contacts 48, 49, 50. This arrangement provides constant electrical communication between the circuit contacts 48, 49, 50 and corresponding ones of the processing unit contacts 18, with physical contact maintained by a combination of the spring forces of the circuit contacts 48, 49, 50 and the coil springs 45, 46, 47. These processing unit contacts 18, coil springs 45, 46, 47, and circuit contacts 48, 49, 50 collectively form the input port 17 that is connected to the sensor cable connector 15 of the sensor cable 3 (see FIG. 1), as described previously.

The perimeter of the upper face of the display 28 is disposed in communication with portions of the lower face of the alignment frame 29. The display 28 can be secured to the alignment frame 29, for example, with a commercially available adhesive, or by a snap fit. Alternatively, the substantially rectangular-shaped opening in the alignment frame 29 can include a ledge on the lower face of the alignment frame 29, to accommodate the display 28 without allowing the display 28 to pass through the rectangular-shaped opening. A flexible, low-profile connector, such as zebra strip, which consists of many short pieces of conducting wire embedded in a non-conducting polymer sheet, is connected to the display 28, for example, along an edge of the display 28.

In the exemplary embodiment shown in FIG. 8, forward portions of the lower face of the display 28 are disposed in electrical communication with a first face of a first zebra strip 54. Rearward portions of the lower face of the display 28 are disposed in electrical communication with a first face of a second zebra strip 55. In an exemplary embodiment, the electrical communication maintained between the display 28 and the zebra strips 54, 55 is accomplished using soldered joints or other electrically-conductive attachment mechanism. A second face of the first zebra strip 54 and a second face of the second zebra strip 55 are disposed in electrical communication with electrical contacts on a printed circuit board 56. Preferably, the electrical communication between the zebra strips 54, 55 and the printed circuit board 56 is maintained using soldered joints or via other electrically-conductive attachment mechanism, such as ribbon cable. The electrical connections between the printed circuit board 56 and the display 28 through the first zebra strip 54 and the second zebra strip 55 are maintained in manner that allows the microprocessor 57, which is disposed on the printed circuit board 56, to control the information presented on the display 28.

Four momentary toggle switches, such as dome switches 58, 59, 60, 61, are disposed in electrical communication with circuit components of the printed circuit board 56. The dome switches 58, 59, 60, 61 are physically secured to the printed circuit board 56, for example, using a commercially available adhesive, by soldered joint, or through a combination of the electrical connection and conformal coating of the printed circuit board 56. The left dome switch 58 is positioned on the printed circuit board 56 proximate to the interior face of the left button 38 such that depressing the left button 38 actuates the left dome switch 58. The right dome switch 59 is positioned on the printed circuit board 56 proximate to the interior face of the right button 39 such that depressing the right button 39 actuates the right dome switch 59. The left forward dome switch 60 is positioned on the printed circuit board 56 proximate to the interior face of the left forward button 40 such that depressing the left forward button 40 actuates the left forward dome switch 60. The right forward dome switch 61 is positioned on the printed circuit board 56 proximate to the interior face of the right forward button 41 such that depressing the right forward button 41 actuates the right forward dome switch 61.

Two battery contacts 62, 63 are disposed in electrical communication with circuit components of the printed circuit board 56. The battery contacts 62, 63 are physically secured to the printed circuit board 56, for example, using a commercially available adhesive, by soldered joints, or through a combination of the electrical connection and conformal coating of the printed circuit board 56. The first battery contact 62 is disposed on the printed circuit board 56 in a vertical orientation, which allows for electrical contact with a first terminal of a coin-cell 64. The second battery contact 63 is disposed on the printed circuit board 56 in a horizontal orientation, which allows for electrical contact with a second terminal of the coin-cell 64. In an exemplary embodiment, the battery contacts 62, 63 are stamped, nickel-plated steel leaf-type spring contacts.

The coin-cell 64 serves as the power source for the processing unit 4. The coin-cell 64 is disposed within the processing unit 4 in manner that allows a user to remove the coin-cell 64 from the processing unit 4 through the battery door opening 26. The coin-cell 64 is disposed in communication with the battery contacts 62, 63 and the interior portion of the battery door 65. The coin-cell 64 is secured to its position with a tension fit provided by spring forces of the contacts 62, 63. The battery door 65 has essentially the same shape as the battery door opening 26 and snaps into place, covering and securing the coin-cell 64, and providing electrical insulation between the coin cell 64 and the circuit contacts 48, 49, 50, if necessary. Alternatively, the battery door 65 can be connected to the upper case 20 by one or more hinges, so that the door 65 can be swung open for replacement of the coin-cell 64. In an exemplary embodiment, the coin-cell 64 is a CR2032 lithium battery.

The circuit contacts 48, 49, 50 are located on the upper rearward portion of the printed circuit board 56, and are disposed in electrical communication with electronic components of the printed circuit board 56. The circuit contacts 48, 49, 50 are physically secured to the printed circuit board 56, for example, using a commercially available adhesive, by soldered joints, or through a combination of the electrical connection and conformal coating of the printed circuit board 56.

The microprocessor 57 is disposed in electrical communication with other circuit components of the printed circuit board 56. The microprocessor 57 is physically secured to the printed circuit board 56, for example, using a commercially available adhesive, by soldered joints, or through a combination of the electrical connection and conformal coating of the printed circuit board 56. The microprocessor 57 is preferably located on the upper face of the printed circuit board 56 proximate to the interior face of the display 28. In an exemplary embodiment, the printed circuit board 56 is manufactured in multiple layers.

An audio device, such as a piezo beeper 69, is mounted on the lower case 21. Voltage terminals of the piezo beeper 69 are exposed toward the printed circuit board 56 to contact terminals on the underside of the printed circuit board 56. When the microprocessor 57 receives instructions to sound the piezo beeper 69, appropriate voltage levels are applied to the terminals, actuating the piezo beeper 69. In order to maintain continuous electrical contact between the piezo beeper 69 voltage terminals and the printed circuit board 56 voltage terminals, a beeper contact spring can be mounted between the piezo beeper 69 and the printed circuit board 56.

The depictions of the present invention provided herein are not limiting of the present invention, but rather are exemplary embodiments of the present invention as currently contemplated by the inventor, and can be modified within the spirit and scope of the present invention.

Preferred and alternative embodiments have been described in detail. It must be understood, however, that the invention is not limited to the particular embodiments described herein. Rather, the invention is defined by the following claims, which should be given the broadest interpretation possible in light of the written description and any relevant prior art.

What is claimed is:

1. An apparatus for monitoring and displaying exertion data, comprising:

a sensor that measures a pressure change at the sensor and provides a pressure signal corresponding to a magnitude of the pressure change;

a processing unit that receives the pressure signal, processes the pressure signal according to processing instructions, generates pressure data corresponding to the pressure signal, and displays a visual representation of the pressure data; and a sensor cable that provides an electrical connection between the sensor and the processing unit, wherein the sensor provides the pressure signal to the processing unit via the sensor cable;

wherein the processing unit includes a microprocessor that receives the pressure signal, processes the pressure signal, generates the pressure data, and generates display data, memory, in which the processing instructions and display data are stored and which provides the processing instructions to the microprocessor to control processing of the pressure signal and display of the visual representation, and a signal transmitter, disposed in electrical communication with the microprocessor;

wherein the signal transmitter is one of a radio frequency transmitter and an infrared transmitter.

2. The apparatus of claim 1, wherein the sensor includes a transducer against which incident pressure is applied and which generates a voltage level proportionate to a magnitude of the incident pressure; and a converter that receives the voltage level and converts the voltage level to the pressure signal.

3. The apparatus of claim 1, wherein the processing unit includes a display for providing the visual representation based on the pressure data.

4. The apparatus of claim 1, wherein the pressure signal is a digital representation or the pressure change.

5. The apparatus of claim 1, further including a fabric base formed in the shape of a glove that is adapted to receive a hand, wherein the sensor and the processing unit are attached to the fabric base.

6. The apparatus of claim 4, wherein the fabric base is made from material including at least one of nylon, leather, and spandex.

7. The apparatus of claim 5, wherein the fabric base includes at least one fastener that allows a fit of the fabric base on the hand to be adjusted.

8. The apparatus of claim 7, wherein said at least one fastener includes a strap with a hook-and-loop fabric closure.

9. The apparatus of claim 5, wherein the sensor is disposed on a region of the fabric base such that the sensor is located proximate to the palm of the glove.

10. The apparatus of claim 5, wherein the sensor is a flexible monolithic pressure sensor.

11. The apparatus of claim 5, wherein the sensor is encased in the fabric base with closed-cell foam.

12. The apparatus of claim 11, wherein the closed-cell foam is covered with at least one aluminized layer.

13. The apparatus of claim 1, wherein the sensor cable includes multiple flat flexible wires.

14. The apparatus of claim 5, wherein the sensor cable is routed from the sensor to the processing unit around one of a base of a thumb section of the glove;

a base of a little finger section of the glove;

between bases of a thumb section and index finger section of the glove; and a location where a wrist section of the glove joins a base of a thumb section of the glove.

15. The apparatus of claim 1, wherein the sensor cable is attached to the processing unit with a snap-fit connector.

16. The apparatus of claim 5, wherein the sensor cable is at least partially disposed between fabric layers of the fabric base.

17. The apparatus of claim 5, wherein the processing unit is disposed on a region of the fabric base such that the processing unit is located proximate to the back portion of the hand when the glove is worn by a user.

18. The apparatus of claim 1, wherein the processing unit further includes a piezo beeper, disposed in electrical communication with the microprocessor.

19. The apparatus of claim 1, wherein the processing unit further includes a clock generator for providing a periodic output signal, disposed in electrical communication with the microprocessor.

20. The apparatus of claim 1, further comprising an antenna communicatively coupled to the signal transmitter.

21. The apparatus of claim 1, wherein the signal transmitter includes an omnidirectional transmission element.

22. An apparatus for monitoring and displaying exertion data, comprising:

a sensor that measures a pressure change at the sensor and provides a pressure signal corresponding to a magnitude of the pressure change;

a processing unit that receives the pressure signal, processing the pressure signal according to processing instructions, and generates pressure data corresponding to the pressure signal;

a sensor cable that provides an electrical connection between the sensor and the processing unit, wherein the sensor provides the pressure signal to the processing unit via the sensor cable; and a display device that displays a graphical representation of the pressure data;

wherein the processing unit includes a microprocessor that receives the pressure signal, processes the pressure signal, generates the pressure data, and generates display data, memory, in which the processing instructions and display data are stored and which provides the processing instructions to the microprocessor to control processing of the pressure signal and display of the visual representation, an upper case, a lower case, and a circuit assembly on which the microprocessor and memory are disposed; and wherein the upper case includes a lens over the display device.

23. The apparatus of claim 22, further comprising a gasket, disposed between the upper case and the lower case, wherein the upper case is secured to the lower case with screws.

24. The apparatus of claim 22, wherein the upper case is made of a polycarbonate material.

25. The apparatus of claim 22, further comprising at least one keypad disposed in at least one respective annular space in the upper case.

26. The apparatus of claim 25, wherein each said at least one keypad is disposed in communication with a respective one of at least one dome switch.

27. The apparatus of claim 26, wherein each said at least one dome switch is electrically connected to input leads of the microprocessor.

28. The apparatus of claim 25, wherein each said at least one keypad is made of santoprene.

29. The apparatus of claim 22, wherein the circuit assembly includes at least one electrical contact to provide electrical communication between the sensor cable and the microprocessor.

30. The apparatus of claim 29, wherein said at least one electrical contact includes at least one coil spring.

31. The apparatus of claim 29, wherein said at least one electrical contact includes at least one zebra strip connector.

32. The apparatus of claim 29, wherein the upper case includes at least one aperture through which electrical contact is made between the sensor cable and said at least one electrical contact.

33. The apparatus of claim 22, wherein the lens is made of at least one of an acrylic material and a clear polycarbonate material.

34. The apparatus of claim 22, wherein the upper case includes a battery enclosure.

35. The apparatus of claim 34, wherein the battery enclosure is adapted to accept a CR2032 lithium battery.

36. The apparatus of claim 22, wherein the display device provides the visual representation of the pressure data at least in the form of a bar graph.

37. The apparatus of claim 22, wherein the display device provides the visual representation of the pressure data at least in the form of alphanumeric characters.

38. The apparatus of claim 22, wherein the display device includes a liquid crystal display.

39. The apparatus of claim 38, wherein the liquid crystal display includes a double-supertwist nematic crystal.

40. The apparatus of claim 22, further comprising a fabric base formed in the shape of a glove that is adapted to receive a hand, wherein the sensor is disposed on a region of the fabric base on the palm of the glove, and the processing unit and the display device are disposed on a side of the fabric base corresponding to the back hand side or the glove shape.

* * * * *